US007617990B2

(12) United States Patent
Huffman

(10) Patent No.: US 7,617,990 B2
(45) Date of Patent: Nov. 17, 2009

(54) SHOWER HEADER WITH REMOVABLE SPRAY NOZZLES

(75) Inventor: David C. Huffman, Merrimack, NH (US)

(73) Assignee: Spraying Systems, Co., Wheaton, IL (US)

( * ) Notice: Subject to any disclaimer, the term of this patent is extended or adjusted under 35 U.S.C. 154(b) by 0 days.

(21) Appl. No.: 11/596,031

(22) PCT Filed: May 11, 2005

(86) PCT No.: PCT/US2005/016234

§ 371 (c)(1),
(2), (4) Date: Aug. 6, 2007

(87) PCT Pub. No.: WO2005/110609

PCT Pub. Date: Nov. 24, 2005

(65) Prior Publication Data

US 2008/0111004 A1 May 15, 2008

Related U.S. Application Data

(60) Provisional application No. 60/570,036, filed on May 11, 2004.

(51) Int. Cl.
*B05B 17/00* (2006.01)
*B05B 15/02* (2006.01)

(52) U.S. Cl. ..... 239/1; 239/114; 239/116; 239/123; 239/390; 239/550; 239/566; 239/596; 239/600; 239/71; 162/275

(58) Field of Classification Search ..... 239/104, 239/106, 114, 115, 116, 123, 390, 548, 550, 239/566, 590, 590.3, 596, 600, 71, 567, 601, 239/DIG. 13, 1, 11; D23/249; 162/275
See application file for complete search history.

(56) References Cited

U.S. PATENT DOCUMENTS

| | | | | |
|---|---|---|---|---|
| 2,298,934 | A | 10/1942 | Foster | |
| 2,987,262 | A | 6/1961 | Goyette et al. | |
| 4,257,559 | A * | 3/1981 | Noren | 239/566 |
| D286,807 | S | 11/1986 | Paige | |
| 5,909,847 | A | 6/1999 | Munsche et al. | |
| 5,927,616 | A * | 7/1999 | Grise et al. | 239/600 |
| 6,073,861 | A | 6/2000 | Wright et al. | |

FOREIGN PATENT DOCUMENTS

| | | | |
|---|---|---|---|
| DE | 2 298 934 | A1 | 11/1983 |
| WO | WO 98/43750 | A1 | 10/1998 |

* cited by examiner

*Primary Examiner*—Steven J Ganey
(74) *Attorney, Agent, or Firm*—Leydig, Voit & Mayer, Ltd.

(57) ABSTRACT

A shower header type spray device is provided. The spray device includes an elongated spray header having a plurality of laterally spaced liquid spray nozzles each of which is mounted in a corresponding pocket in the spray header. An elongated cleaning brush assembly includes a rotatable brush housed in the spray header for cleaning inlet apertures of the spray nozzles. At least one spray nozzle has a dome portion with a discharge orifice and a substantially flat mounting flange portion extending around the periphery of the dome portion. The mounting flange portion of the at least one spray nozzle has a notch adapted to receive a removal tool for enabling prying and dislodgment of the at least one spray nozzle from its respective pocket in the spray header.

13 Claims, 2 Drawing Sheets

SHOWER HEADER WITH REMOVABLE SPRAY NOZZLES

FIELD OF THE INVENTION

The present invention relates generally to liquid spraying systems, and more particularly to shower header-type spray devices having a plurality of inset mounted spray nozzles which are adapted to direct individual liquid flow streams and are configured such that discharge orifices of the nozzles can be simultaneous cleaned by a rotary brush mounted within the header.

BACKGROUND OF THE INVENTION

Shower header-type spray devices commonly are used in many industrial applications, such as for directing cleaning fluids onto rollers in pulp and paper mills and spraying cooling liquids onto processed metals in steel mills. Such spray devices include an elongated header having a plurality of laterally spaced spray nozzles which are adapted for directing a curtain of liquid onto the processing line. Since a single processing line can include a multiplicity of such header-type shower spraying systems, significant cleaning, cooling, or other processing fluids can be used. To conserve processing fluid, it is common to collect the liquid during the course of a processing cycle, filter out the debris and contaminants from the fluid during a recycling process, and to reuse the liquid. Nevertheless, some solid particles and matter can pass through the filtering system which over time can plug or impede liquid flow through one or more of the spray nozzles in the header.

It is known for shower headers to include an elongated cleaning brush which can be rotated to cause bristles of the brush to move across and clean the discharge orifices of the spray nozzles in the header. To facilitate such cleaning, the nozzles are mounted within respective recesses or pockets in the underside of the header and the discharge orifices thereof of the nozzles formed in upwardly protruding domes of the nozzles. The nozzles are tightly secured and retained in respective pockets by locking rings. While such nozzles lend themselves to easy brush cleaning, from time to time it still is necessary to remove the nozzles because of clogging, wear, or replacement with nozzles of a different discharge orifice design for a particular spray application. After being in service for some time, the nozzles can become stuck in the mounting pocket by reason of material buildup or high temperature adhesion to an adjacent ceiling gasket, making removal difficult. In many cases, the nozzle is irreparably damaged in the removal process.

OBJECTS AND SUMMARY OF THE INVENTION

It is an object of the present invention to provide a spray header having recess or pocket mounted spray nozzles which are adapted for easy removal and replacement, even after prolonged usage of the spray header and buildup of contaminants about the spray nozzle.

Another object is to provide a spray nozzle having a unique design which facilitates removal from a recessed or pocket mounting thereof.

Still another object is to provide a spray nozzle of the above kind which is relatively simple in construction and economical to produce.

A further object is to provide an improved method of removing pocket mounted nozzles in shower-type spray headers.

Other objects and advantages of the invention will become apparent upon reading the following detailed description and upon reference to the drawings, in which:

Figure 1:
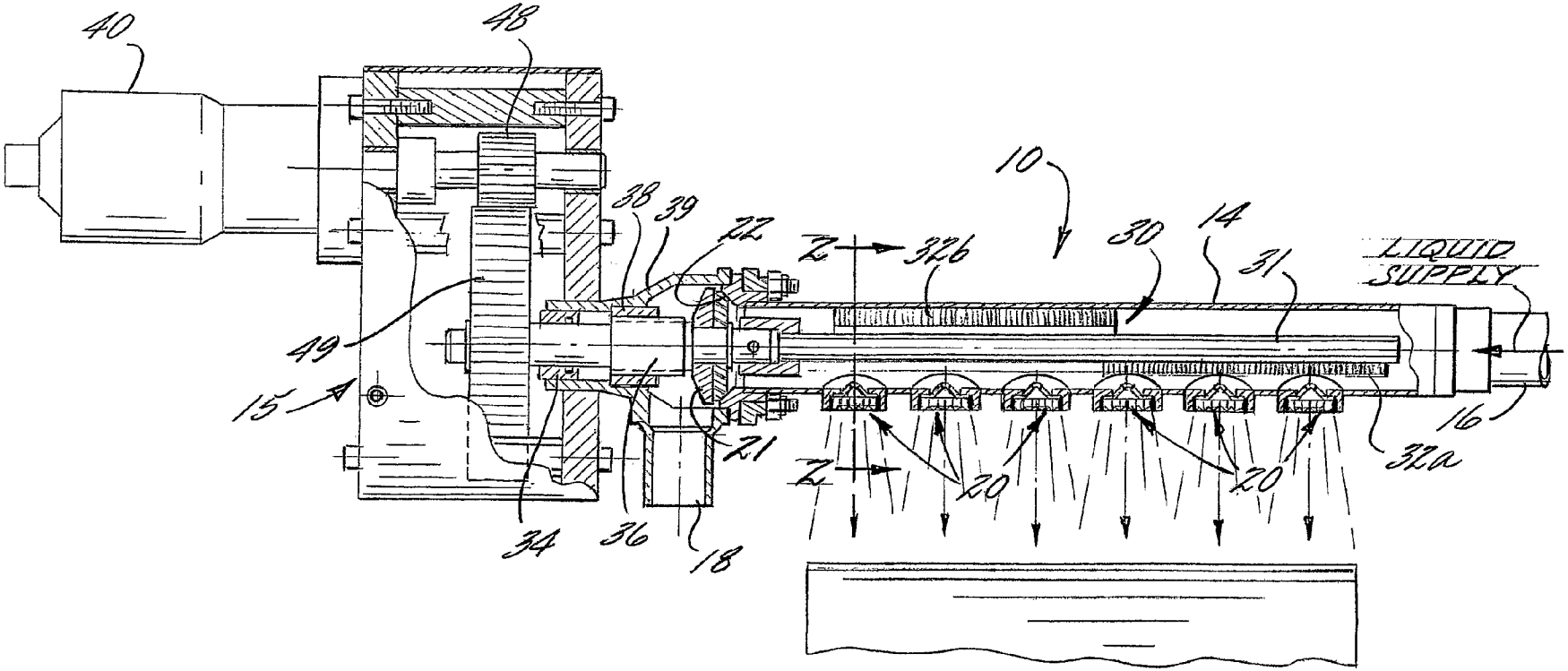
FIG. 1 is a longitudinal, vertical section of an illustrative shower header spray device having pocket mounted spray nozzles in accordance with the invention.
Figure 2:
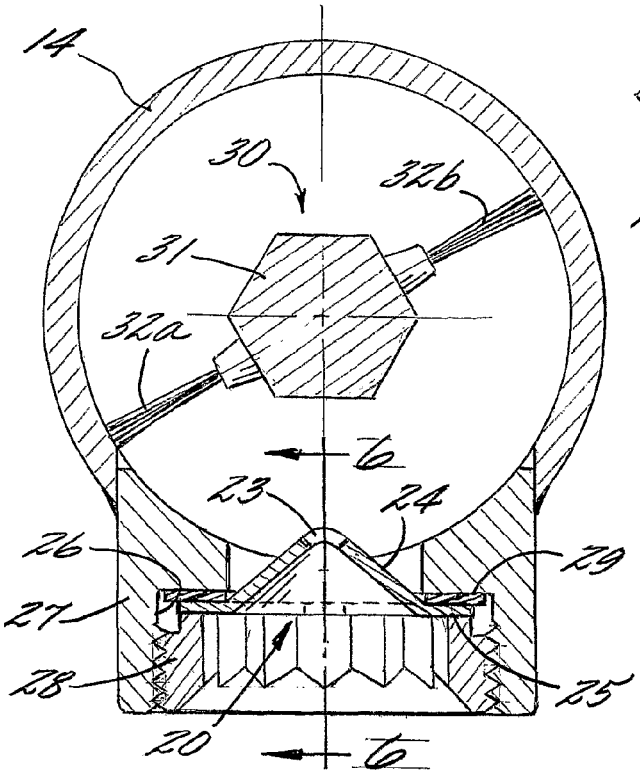
FIG. 2 is an enlarged vertical section of the illustrated spray device, taken in the plane of line 2-2 in FIG. 1.
Figure 3:
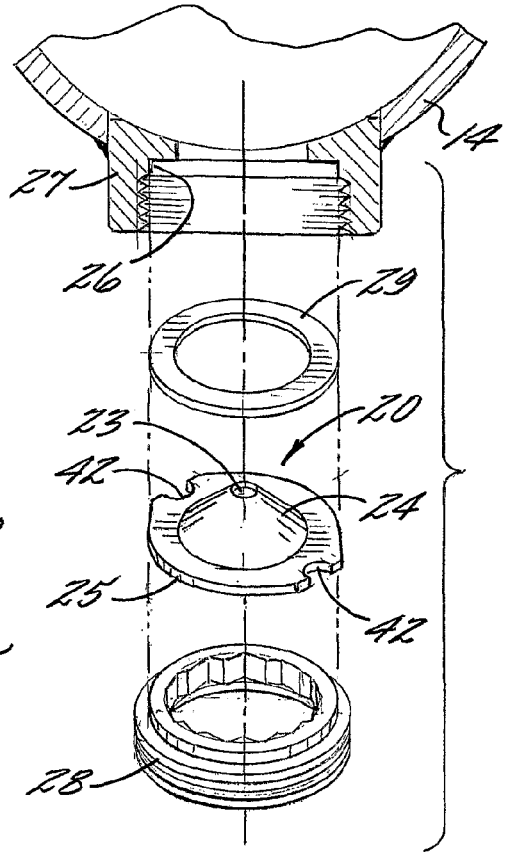
FIG. 3 is an exploded view of the spray nozzle and its mounting components shown in FIG. 2.
Figure 4:
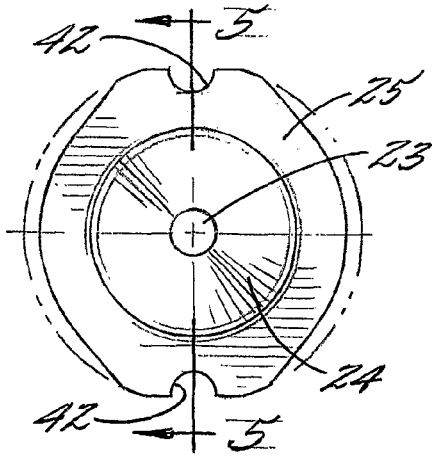
FIG. 4 is a top plan view of the illustrated nozzle.
Figure 6:
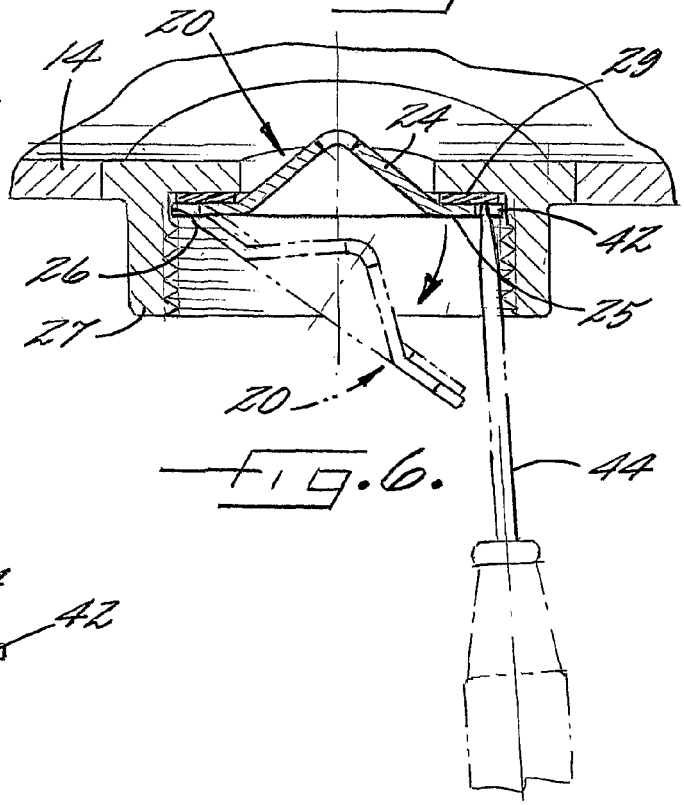
FIG. 6 is a vertical section of the spray device illustrating removal of the spray nozzle.
Figure 5:
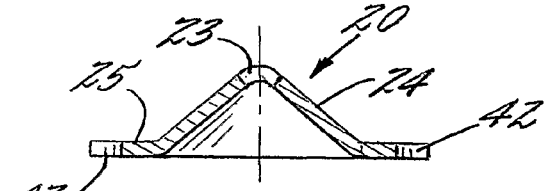
FIG. 5 is a vertical section of the nozzle taken in the plane of line 5-5 in FIG. 4.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative shower header-type spray device 10 in accordance with the invention, which has particular utility in paper and steel processing applications in which an elongated curtain of a liquid spray is emitted from the header. The basic construction and operation of the illustrated shower header-spray device 10 is similar to the spray device disclosed in U.S. application Ser. No. 10/735,365 filed Dec. 12, 2003, assigned to the same assignee as the present application, the disclosure of which is incorporated herein by reference.

The illustrated shower header-spray device 10, as depicted in FIG. 1, includes an elongated generally tubular-configured header 14 supported in cantilever relation from a support frame 15. The header 14 has an upstream end connected to a pressurized liquid supply 16, a drain pipe 18 communicating with a downstream end of the header 14, in this case extending in radial downward relation to the header 14, and a plurality of spray nozzles 20 mounted at uniformly spaced intervals laterally along the header 14. The illustrated header 14 includes a valve member 21, which is positionable against a valve seat 22 at the downstream end of the header 14 for sealing the downstream end of the header during a liquid spraying operation. Hence, pressurized liquid introduced into the inlet end of the header 14 is directed through the header and discharges through the plurality of spray nozzles 20.

The spray nozzles 20, typical of spray nozzles used in such shower headers type spray devices, have discharge orifices 23 defined centrally within an upwardly extending dome portion 24 which is surrounded by a bottom flat peripheral mounting flange 25. The spray nozzles 20, each are mounted within a recess or pocket 26 in the bottom of the header 14 with the discharge orifice defining dome portion 24 extending upwardly into the header. The recess pockets 26, in this care are defined by individual base members 27 supported within a bottom longitudinally extending wall of the header 14. For securing the spray nozzles 20 in mounted position, a locking ring 28 is screwed into the underside of the pocket for retaining the mounting flange 25 in position, preferably with a gasket 29 interposed between the mounting flange 25 and the header pocket 26. The mounting flanges 25 of the illustrated spray nozzles 20 and their respective pockets 26 each have a non-circular elongated configuration, aligned along the length of the header 14, for assuring proper orientation of the nozzle discharge orifices 23.

To facilitate cleaning of the discharge orifices of the plurality of spray nozzles, a cleaning brush 30 is housed within the header 14, which includes a radial cleaning bristles. The brush shaft 31 is supported at opposite ends in appropriate bearings 34 for rotational and axial movement with respect to the header 14.

The brush segments 32*a*, 32*b* preferably are oriented in diametrically opposed relation to the shaft 31 such that as an incident to rotation of the shaft 31, the brush segments 32*a*, 32*b* successively clean respective numbers of the laterally spaced spray nozzles 20. In the illustrative embodiment, the brush segment 32*a* is operable for cleaning three laterally spaced spray nozzles 20 adjacent an upstream end of the header 14, while the brush segment 32*b* is operable for cleaning the three laterally spaced spray nozzles 20 adjacent a downstream end of the header 14.

For imparting simultaneous axial movement of the brush shaft 31 as an incident to rotation thereof, a downstream end of the brush shaft 31 has a threaded pinion 36 which is disposed within a nut 38 fixed within a downstream housing section 39 of the header 14. Hence, as an incident to the rotation of the shaft 31 in one direction, the pinion 36 moves axially to the left in the nut 38, causing the brush segments 32*a*, 32*b* to move with a combination rotary and axial movement in sweeping fashion across the inlet ends of the nozzles 20 such that the bristles move any debris or solid material that is encumbering or clogging the passage of cleaning fluid to the nozzles. The valve member 21 in this case is mounted on a downstream end of the shaft 31, such that such rotation of the shaft, which advances the brush 30 in a downstream direction, simultaneously moves the valve member 21 to an open position away from the valve seat 22, allowing pressurized liquid from the supply liquid to carry removed debris through the header 14 and out the discharge drain 18. Rotational movement of the shaft in an opposite direction causes the brush segments 32*a*, 32*b* to rotate and axially move in an opposite sweeping fashion across the nozzles 20 until the valve member 21 is seated with the valve seat 22, closing the header 14 from the drain 18, thereby enabling the header to resume a spraying.

A drive motor 40 in this case is mounted on the support frame 15 and is operatively connected, via a drive pinion 48 and drive gear 49, to the cleaning brush shaft for effecting rotation of the cleaning brush. The pinion and drive gears 48, 49 are sufficiently wide in the axial direction so as to permit limited longitudinal movement of the gear 49 relative to the pinion with the brush shaft 31 as an incident to the brush shaft being rotatably driven.

As indicated previously, while the elongated cleaning brush 30 is an efficient means for cleaning the discharge orifices 23 of the spray nozzles 20 without removal from the header 14, from time to time it still is necessary to remove the with a different spray orifice design. Because of the inaccessibility of the spray nozzles 20 within the recess mounting pockets 26, the build-up of contaminants about the spray nozzle over time and adhesion of the spray nozzle 20 to the sealing gasket 29 can make it quite difficult to effect removal of the spray nozzles 20 when necessary. Moreover, due to their relatively fragile construction, it is not uncommon to irreparably damage the spray nozzles 20 during removal.

In accordance with the present invention, the spray nozzles have a unique design which facilitates removal from their mounting pockets even when severely contaminated or adhered to an adjacent sealing gasket. To this end, each spray nozzle 20 is provided with one or more notches or slots 42 in the mounting flange 25 thereof which is adapted to receive the end of a removal tool 44, such as a screw driver or ice pick, to enable prying and dislodgment of the spray nozzle 20 from its mounting pocket 26 without damage to the nozzle. In illustrated spray nozzles 20, notches 42 are formed in the peripheral diametrically opposed ends of the mounting flange on the long axis thereof. The notches 42 in this case are semi-secular in configuration, opening to the outer perimeter of the mounting flange, and have a relatively small radius of about 0.075 inches. Notwithstanding such small dimensions, it is easy for an operator to insert the end of a small bladed screw driver or ice pick 44 into the notch 42 to pry the nozzle 20 out from its mounted position even when subject to severe contamination or adhesion to the mounting gasket. Since the notches 42 are formed in the flat mounting flange 25 of the spray nozzle 20, prying forces act on the radial flange 25 with less likelihood of damage to the nozzle. While in the illustrated embodiment, the notches 42 are formed in the peripheral edges of the nozzle mounting flanges 25, it will be understood that alternatively an aperture, slot or the like could be formed elsewhere in the flat mounting flange 25.

From the foregoing, it will be seen that the novel design of the spray nozzles permit easy removal and replacement of the nozzles from their recess pocket mountings without damage, even after prolong usage of the spray header and build-up of contaminants about the spray nozzle. The method of removal by means of a simple screwdriver, ice pick or other like instrument can be accomplished quickly and easily.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A shower header type spray device comprising:

an elongated spray header having a plurality of laterally spaced liquid spray nozzles arranged in alignment parallel to a longitudinal axis of the header, said plurality of laterally spaced liquid spray nozzles each being mounted in a corresponding pocket in the elongated spray header;

an elongated cleaning brush assembly including a rotatable brush housed in the elongated spray header for cleaning discharge orifices of the plurality of laterally spaced liquid spray nozzles;

said plurality of laterally spaced liquid spray nozzles each having a dome portion with a discharge orifice and a substantially flat mounting flange portion extending around the periphery of the dome portion;

said mounting flange portion of each spray nozzle having a notch adapted to receive a removal tool for enabling prying and dislodgment of each spray nozzle from its respective pocket in the spray header, and said plurality of laterally spaced liquid spray nozzles being mounted with the notch of each mounting flange portion arranged in alignment along a line parallel to the longitudinal axis of said elongated spray header.

2. The shower header device according to claim 1, further including a respective locking member that engages the mounting flange portion of each spray nozzle to retain the spray nozzle in its respective pocket in the spray header.

3. The shower header device according to claim 1 in which said mounting flange portion is formed with a pair of diametrically opposed notches in alignment parallel to the longitudinal axis of the elongated spray header.

4. A spray header type spray device comprising an elongated spray header with a plurality of laterally spaced pockets for receiving spray nozzles, said spray nozzles each comprising a dome portion with a discharge orifice and a substantially flat mounting flange portion extending around the periphery of the dome portion, the mounting flange portion of each spray nozzle having an elongated, non-circular configuration with opposite elongated ends thereof arranged along a longitudinal axis of the elongated flange portion, said spray nozzles being mounted in said elongated spray header with the longitudinal axis of the elongated flange portions similarly oriented with respect to a longitudinal axis of the elongated spray header, and said spray nozzles each being formed with at least one notch in one of said elongated ends adapted to receive a removal tool for enabling prying and dislodgment of each spray nozzle from its respective pocket in the elongated spray header.

5. The spray header type spray device according to claim 4, wherein the at least one notch in the one elongated end of the mounting flange portion of each spray nozzle has a substantially semi-circular configuration that opens to an outer perimeter of the mounting flange portion.

6. The spray header type spray device according to claim 4, wherein the mounting flange portion of each spray nozzle has a pair of diametrically opposed notches in the mounting flange portion.

7. The spray nozzle according to claim 4 wherein the mounting flange portion of each spray nozzle has a pair of diametrically opposed notches in the mounting flange portion arranged in alignment parallel to a longitudinal axis of the elongated spray header.

8. A shower header type spray device comprising:

an elongated spray header having a plurality of laterally spaced liquid spray nozzles each of which is mounted in a corresponding pocket in the elongated spray header; and an elongated cleaning brush assembly including a rotatable brush housed in the spray header for cleaning of the discharge orifices plurality of laterally spaced liquid spray nozzles;

at least one spray nozzle of said plurality of laterally spaced liquid spray nozzles having a dome portion with a discharge orifice and a substantially flat mounting flange portion extending around the periphery of the dome portion;

said mounting flange portion of the at least one spray nozzle of said plurality of laterally spaced liquid spray nozzles having at least one notch adapted to receive a removal tool for enabling prying and dislodgment of the at least one spray nozzle of said plurality of laterally spaced liquid spray nozzles from its respective pocket in the elongated spray header, and said mounting flange portion of said at least one spray nozzle of said plurality of laterally spaced liquid spray nozzles having an elongated non-circular configuration with a longitudinal axis that extends parallel to a longitudinal axis of the header.

9. The shower header spray device according to claim 8 wherein the at least one notch in the mounting flange portion of the at least one spray nozzle of said plurality of laterally spaced liquid spray nozzles has a substantially semi-circular configuration that opens to an outer perimeter of the mounting flange portion.

10. The shower header spray device according to claim 8 wherein the mounting flange portion of the at least one spray nozzle of said plurality of laterally spaced liquid spray nozzles has a pair of diametrically opposed notches in the mounting flange portion.

11. The shower header spray device according to claim 8 wherein the mounting flange portion of the at least one spray nozzle of said plurality of laterally spaced liquid spray nozzles has a pair of diametrically opposed notches in the mounting flange with a respective one of the notches being at each end of the mounting flange portion on the longitudinal axis thereof.

12. The shower header device according to claim 8 further including a gasket that is interposed between the mounting flange portion of the at least one spray nozzle of said plurality of laterally spaced liquid spray nozzles and its respective pocket in the elongated spray header.

13. A method of installing and removing liquid spray nozzles in an elongated spray header having a cleaning brush rotatably supported in the elongated spray header for cleaning discharge orifices of the spray nozzles, comprising the steps of:

mounting a plurality of spray nozzles in respective longitudinally spaced pockets of the elongated spray header with each spray nozzle having a dome with a discharge orifice and a substantially flat mounting flange portion extending around the periphery of the dome formed with a notch and with the discharge orifice of each spray nozzle positioned for contact by the cleaning brush rotatably supported in the elongated spray header, retaining the plurality of spray nozzles in the respective pockets by respective retaining devices that engage the flat mounting flange portion, and removing the plurality of spray nozzles for cleaning and/or replacement by removing the retaining devices and engaging the notch of the flat mounting flange portion with a removal tool for prying and dislodging the plurality of spray nozzles from the respective pockets of the elongated spray header.

* * * * *